US006286946B1

(12) United States Patent
Umemura et al.

(10) Patent No.: US 6,286,946 B1
(45) Date of Patent: Sep. 11, 2001

(54) INK CARTRIDGE DEVICE

(75) Inventors: Shunji Umemura; Ayao Ogawa, both of Holaka-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/415,631

(22) Filed: Oct. 12, 1999

(30) Foreign Application Priority Data

Oct. 15, 1998 (JP) ..... 10-293779

(51) Int. Cl.[7] ..... B41J 2/175
(52) U.S. Cl. ..... 347/86
(58) Field of Search ..... 347/85, 86, 87, 347/108, 31, 36

(56) References Cited

U.S. PATENT DOCUMENTS 5,231,416 * 7/1993 Terasawa et al. ..... 347/23
5,701,995 * 12/1997 Higuma et al. ..... 206/205
6,168,266 * 1/2001 Ishinaga et al. ..... 347/86

FOREIGN PATENT DOCUMENTS 5-270002 * 10/1993 (JP) .

* cited by examiner

*Primary Examiner*—N. Le
*Assistant Examiner*—Michael Nghiem
(74) *Attorney, Agent, or Firm*—Hogan & Hartson, L.L.P.

(57) ABSTRACT

There is provided an ink cartridge device which permits a delivery port-sealing film thereof to be positively peeled off and prevents ink from scattering out of the device during an operation for peeling off the delivery port-sealing film. An ink cartridge has an ink delivery port for supplying ink to the printer therefrom, and a rim of the ink delivery port. A container box contains the ink cartridge and has a box body and a lid for closing the box body. The box body is formed with a slit. A delivery port-sealing film has a sealing portion removably welded to the rim of the ink delivery port, for sealing the ink delivery port, and an unsealing operation portion continuous with the sealing portion and extending in a direction of making a U-turn with respect to the sealing portion to extend out of the container box through the slit of the box body.

6 Claims, 10 Drawing Sheets

INK CARTRIDGE DEVICE

BACKGROUND OF THE INVENTION

1. Field of the Invention

This invention relates to an ink cartridge device for use with an ink jet printer.

2. Prior Art

FIGS. 9A and 9B show a conventional ink cartridge. The ink cartridge 80 is comprised of a cartridge body 82 having three (YMC) ink reservoirs 81 for holding yellow ink, magenta ink, and cyan ink, a delivery port-sealing film 84 sealing ink delivery ports 83 of the cartridge body 82, and an air inlet port -sealing film 87 sealing ink-charging ports 85 and air inlet ports 86 of the cartridge body 82. In the state constructed above, the ink cartridge 80 is enclosed in an aluminum package, not shown, for shipment. Ink in the cartridge body 82 is made liable to degradation by exposure to air. To avoid this inconvenience, the ink cartridge 80 has the ink delivery ports 83 thereof sealed by the delivery port-sealing film 84, and then, after being charged with ink from the ink-charging ports 85 in a vacuum chamber, the ink-charging ports 85 and air inlet ports 86 are sealed by the air inlet port-sealing film 87. In this state, the ink cartridge 80 is vacuum-packed in an aluminum package for supply to the user.

When the ink cartridge 80 is used by the user, first, the aluminum package is unsealed to take out the ink cartridge 80, and thereafter, part (peel-off portion 87*a*) of the air inlet port-sealing film 87 is peeled off, and the air inlet ports (actually, upstream ends of meandering air inlet passages continuous with the respective air inlet ports) 86 are opened to the atmosphere, while the delivery port-sealing film 84 is peeled off to open the ink delivery ports 83. In this state, the ink cartridge 80 is loaded in a printer.

The conventional ink cartridge having the above construction suffers from the problem that when the delivery port-sealing film is removed from (peeled off) the cartridge body, ink held in the vicinity of the ink delivery ports may be scattered (spilled) and ink adhering to the delivery port-sealing film, particularly, a delivery port-sealing portion thereof may touch the user's hand, so that the user's hand, a desk, or the like can be stained with the ink. Further, there is a fear that the user forgets to peel off the delivery port-sealing film and loads the ink cartridge still covered therewith in the printer. Further, the conventional ink cartridge has the inconvenience that since the inside of the cartridge body is under reduced pressure, air can be mixed into ink to cause a faulty printing operation, unless the films are peeled off in order of the air inlet port - sealing film, first, and then the delivery port-sealing film, in accordance with an instruction manual of the ink cartridge supplied to the user.

SUMMARY OF THE INVENTION

It is an object of the invention to provide an ink cartridge device which permits a delivery port-sealing film to be positively peeled off and prevents ink from scattering out of the device when the delivery port-sealing film is peeled off.

To attain the first object, according to a first aspect of the invention, there is provided an ink cartridge device for a printer, comprising:

an ink cartridge having an ink delivery port for supplying ink to the printer therefrom, and a rim of the ink delivery port;

a container box for containing the ink cartridge, the container box having a box body and a lid for closing the box body, the box body being formed with a slit; and a delivery port-sealing film having a sealing portion removably welded to the rim of the ink delivery port, for sealing the ink delivery port, and an unsealing operation portion continuous with the sealing portion and extending in a direction of making a U-turn with respect to the sealing portion to extend out of the container box through the slit of the box body.

According to this ink cartridge device, if the unsealing operation portion extending out of the box body through the slit is pulled while holding the container box, the sealing portion continuous with the unsealing operation portion is drawn in a manner making a U-turn and peeled off the ink delivery port. In this operation, the sealing portion being peeled off is drawn in a direction orthogonal to the direction of the axis of the ink delivery port. This makes it possible to suppress scattering of ink from the ink delivery port. Further, even if ink is scattered, the scattered ink can be received within the box body.

Preferably, an end of the sealing portion remote from the unsealing operation portion is fixedly attached to the box body.

According to this preferred embodiment, when peeling of the delivery port-sealing film has been completed, the film is prevented from being drawn out any further, which enables the user to recognize that the peeling operation has been completed, even without viewing a peeled-off portion of the film. Further, the user can dispose of the delivery port-sealing film stained with ink along with the container box therefor.

Preferably, a distal end portion of the unsealing operation portion extending out of the container box is folded to extend under the lid in a closed state.

According to this preferred embodiment, when the ink cartridge is not desired to be put into use, it is possible to prevent the unsealing operation portion from being erroneously pulled to peel off the delivery port-sealing film. Moreover, part of the unsealing operation portion extending out of the container box is prevented from obstructing a packing operation for packing the container box containing the ink cartridge, for instance.

Preferably, the box body has a belt-like portion extending therefrom such that the belt-like portion covers the unsealing operation portion extending out of the container box from outside, the belt-like portion including a holding portion holding the unsealing operation portion such that the unsealing operation portion extends along a side surface of the box body, and an insertion portion folded to be inserted under the lid together with the distal end portion of the unsealing operation portion, and the insertion portion being separably continuous with the holding portion and having the distal end portion of the unsealing operation portion fixedly attached thereto.

According to this preferred embodiment, the unsealing operation portion can be held by the belt-like portion such that it extends along a side surface of the box body, so as to prevent the same from obstructing a packing operation or the like. Further, the insertion portion is torn off from the holding portion to separately draw the unsealing operation portion, whereby the insertion portion can be used as a pull tab for peeling off the delivery port-sealing film. During the peeling operation, even if the sealing portion peeled off is drawn out of the container box, a surface of the sealing portion stained with ink is bought into sliding contact with the holding portion, thereby preventing ink from attaching to a desk or the like.

Preferably, an inner surface of the box body facing toward the ink delivery port is provided with an ink-absorbing portion capable of absorbing ink.

According to this preferred embodiment, ink scattered by peeling of the delivery port-sealing film or ink adhering to the delivery port-sealing film peeled off can be efficiently absorbed by the ink-absorbing portion of the inner surface of the box body.

Preferably, the ink cartridge has an air inlet port corresponding to the ink delivery port, for permitting air to flow into an inside of the ink cartridge, and a rim of the air inlet port, the ink cartridge device further including an air inlet port-sealing film for sealing the air inlet port of the ink cartridge, the air inlet port-sealing film having an air inlet port-sealing portion removably welded to the rim of the air inlet port, and an air inlet port-unsealing operation portion continuous with the air inlet port-sealing portion, the air inlet port-unsealing operation portion being fixedly attached to the lid, for permitting the air inlet port-sealing portion to be peeled off by an opening operation for opening the lid.

According to this preferred embodiment, when the lid is opened so as to take out the unsealing operation portion folded under the lid, the air inlet port-sealing film is automatically pulled to thereby peel the same off the ink cartridge. That is, when the lid is opened, the air inlet port-sealing film is first pulled off and then, the delivery port-sealing film is peeled off by pulling the unsealing operation portion. Thus, the air inlet port and the ink delivery port are made open to the atmosphere, in the mentioned order. Therefore, even if the ink cartridge is supplied to a user in a state reduced in pressure inside, air is prevented from being mixed into the ink held therein when the ink cartridge is put into use.

Preferably, the lid is formed with an opening tab, for being pulled up to carry out the opening operation for opening the lid, the air inlet port-unsealing operation portion being fixedly attached to the opening tab.

According to this preferred embodiment, by pinching and pulling the opening tab, the air inlet port-sealing film is automatically torn off simultaneously when the lid is opened. The air inlet port-unsealing operation portion is fixedly attached to the opening tab, and the user directly pulls this operation portion. This makes it possible to positively or reliably peel off the air inlet port-sealing film even when the lid is low in rigidity.

Preferably, the box body has an upper end opposed to the lid, the upper end being formed with a cut -away portion for permitting the ink cartridge contained therein to be seized to draw out the ink cartridge.

According to this preferred embodiment, when the ink cartridge is finally taken out from the container box, the cartridge is seized via the cut-away portion, whereby the cartridge can be easily taken out without turning the container box upside down.

To attain the above object, according to a second aspect of the invention, there is provided an ink cartridge device for a printer, comprising:

an ink cartridge having an ink delivery port for supplying ink to the printer therefrom, and a rim of the ink delivery port;

a container box for containing the ink cartridge;

a delivery port-sealing film having a sealing portion removably welded to the rim of the ink delivery port, for sealing the ink delivery port, and an unsealing operation portion continuous with the sealing portion and fixedly attached to the container box, the sealing portion being peeled off within the container box as a drawing operation for drawing out the ink cartridge from the container box is carried out; and braking means for braking the drawing operation.

When the delivery port-sealing film is peeled off within the container box by utilizing the drawing operation for drawing out the ink cartridge from the container box, if the drawing operation is carried out violently, there is a fear that ink scatters out of the container box, since ink leaking from the ink delivery port also has motility in the direction of drawing out of the ink cartridge.

According to this ink cartridge device, the drawing operation for drawing out the ink cartridge is braked, whereby the ink cartridge is forced to be slowly drawn out or removed from the container box. This makes it possible to effectively prevent ink from scattering out of the container box when the delivery port-sealing film is peeled off.

Preferably, the braking means comprises an auxiliary film which has one end thereof removably welded to the ink cartridge, and another end thereof fixedly attached to the container box, and the drawing operation is braked by a peeling operation for peeling off the auxiliary film.

Alternatively, the ink delivery port opens in one end face of the ink cartridge, the braking means comprising outward projections formed on respective side surfaces of the ink cartridge toward the one end face thereof, and inward projections formed on respective inner surfaces of the container box toward an opening of the container box which permits the ink cartridge to be drawn out therefrom, and the drawing operation being braked by bringing the outward projections and the inward projections into sliding contact with each other.

Alternatively, the braking means comprises a welded portion continuous with an end of the sealing portion remote from the unsealing operation portion and removably welded to the ink cartridge, and the drawing operation being braked by a peeling operation for peeling off the welded portion.

According to these preferred embodiments, in the course of drawing out the ink cartridge, the cartridge can be smoothly braked without causing the user to feel that the cartridge is lodged. It should be noted that the braking operation is effected immediately after peeling of the delivery port-sealing film has been completed.

To attain the above object, according to a third aspect of the invention, there is provided an ink cartridge device for a printer, comprising:

an ink cartridge having an ink delivery port for supplying ink to the printer therefrom, and a rim of the ink delivery port;

a delivery port-sealing film having a sealing portion removably welded to the rim of the ink delivery port, for sealing the ink delivery port, and an unsealing operation portion continuous with the sealing portion, for being pulled to carry out a peeling operation for peeling off the sealing portion before the ink cartridge is mounted in the printer; and a peeling guide portion which restricts a direction of the peeling operation carried out by the unsealing operation portion to a direction of the sealing portion making a U turn.

According to this ink cartridge device, when the unsealing operation portion is pulled, the sealing portion continuous with the unsealing operation portion is drawn in a manner making a U-turn and peeled off the rim of the ink delivery port. The sealing portion being pulled off is drawn in a direction orthogonal to the direction of the axis of the ink delivery port. This makes it possible to prevent ink from scattering from the ink delivery port.

Preferably, the ink cartridge device further includes a scattering prevention member removably fitted on the ink cartridge such that the scattering prevention member covers the sealing portion, for receiving ink scattered by the peeling operation.

According to this preferred embodiment, even if ink is scattered by the peeling operation, the scattered ink can be received by the scattering prevention member. Further, the scattering prevention member which received the scattered ink can be removed from the ink cartridge and disposed of.

The above and other objects, features, and advantages of the invention will become more apparent from the following detailed description taken in conjunction with the accompanying drawings.

BRIEF DESCRIPTION OF THE DRAWINGS

FIGS. 6 to 6C are cross-sectional views of an ink cartridge device according to a third embodiment of the invention, which are useful in explaining peeling of a delivery port-sealing film of the ink cartridge device effected when an ink cartridge of the inlet cartridge device is drawn out from a container box of the same and braking of the drawing operation;

DETAILED DESCRIPTION

Figure 1B:
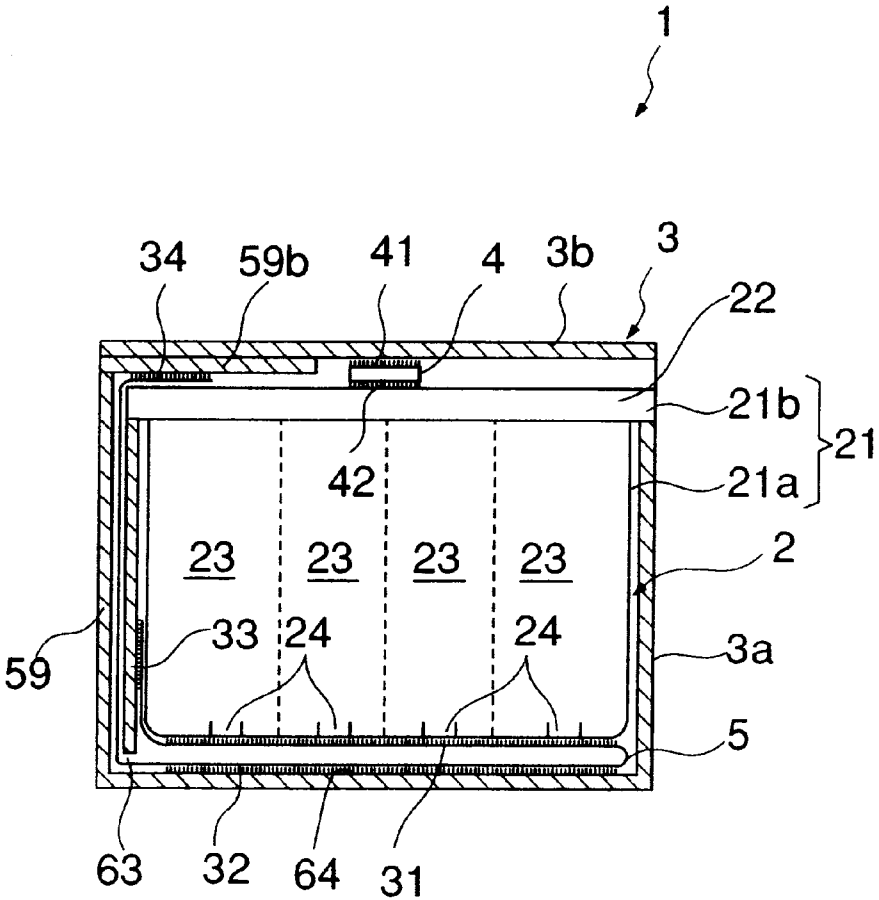
FIG. 1B is a longitudinal cross-sectional view of the ink cartridge device.
Figure 1A:
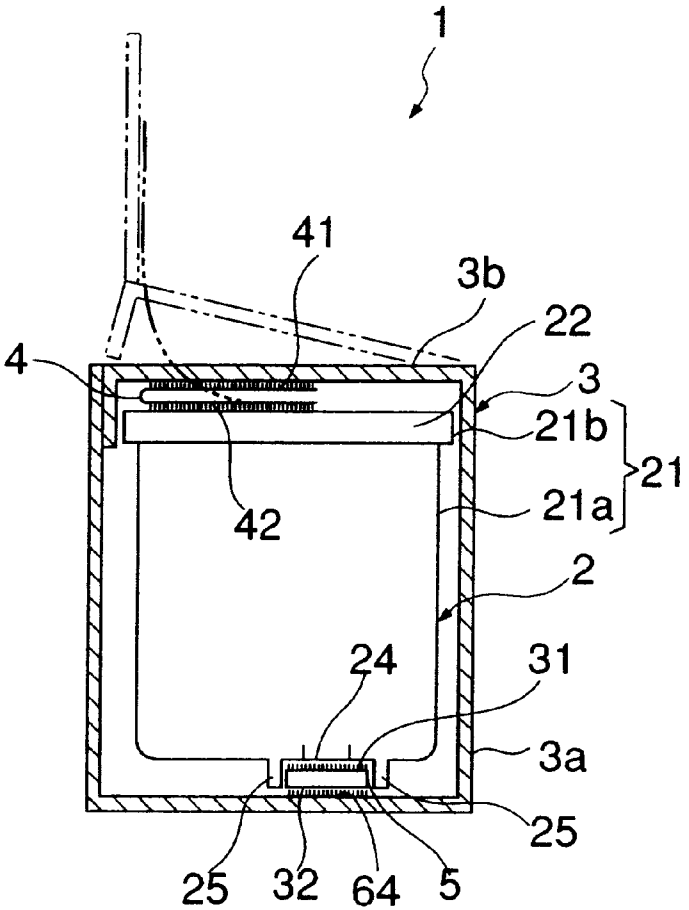
FIG. 1A is a transverse cross-sectional view of an ink cartridge device according to a first embodiment of the invention.
Figure 2A:
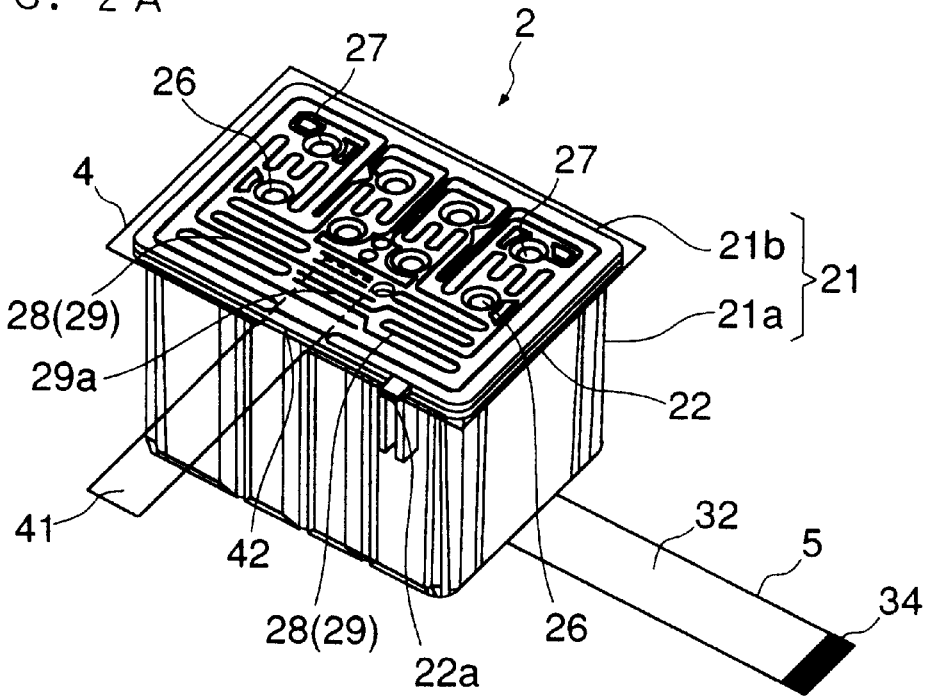
FIG 2A is a perspective view of an appearance of the ink cartridge.
Figure 2B:
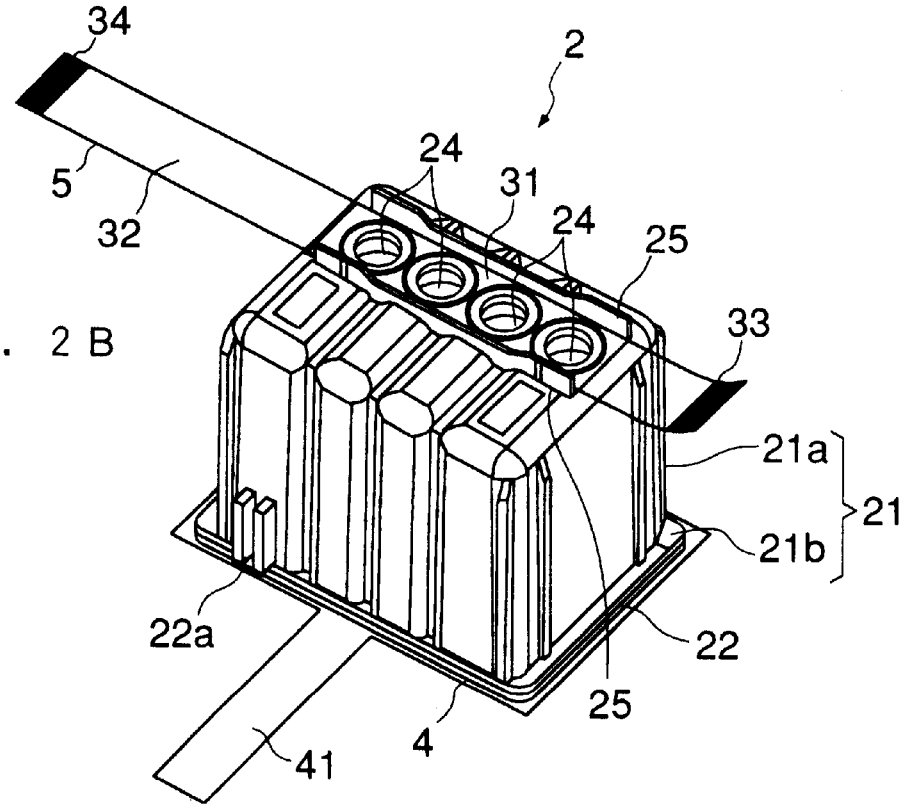
FIG. 2B is a perspective view of an appearance of the ink cartridge with an upper casing-side down.

The invention will now be described in detail with reference to drawings showing embodiments thereof. FIGS. 1A and 1B show transverse and longitudinal cross sections of an ink cartridge device for a printer, according to a first embodiment of the invention. The ink cartridge device 1 includes an ink cartridge 2 filled with four colors of ink, and a container box 3 for containing the ink cartridge 2. The container box 3 is comprised of a box body 3*a* and a lid 3*b* integrally formed with the box body 3*a* in a manner such that the box body 3*a* can be closed and opened by the lid 3*b*. The ink cartridge 2 has an air inlet port-sealing film 4 and a delivery port-sealing film 5 attached to top and bottom surfaces thereof, respectively, by hot-melt bonding. The ink cartridge device 1 thus sealed is provided to the user in a state hermetically enclosed in a package, not shown.

The user unseals the package to take out the container box 3 and opens the lid 3*b*, whereby he can automatically peel (part of) the air inlet port-sealing film 4 off the ink cartridge body 2. Then, by pulling a distal end portion of the delivery port-sealing film 5 extending out of the container box 3, he can peel the delivery port-sealing film 5 off the ink cartridge 2. This permits the ink cartridge 2 to be loaded in the printer.

As shown in FIGS. 1A to 2B, the ink cartridge 2 includes a cartridge casing 21 which is comprised of a lower casing 21*a* and an upper casing 21*b* as a cover welded to an upper end of the lower casing 21*a*. The upper casing 21*b* has a flanged peripheral portion 22 slightly protruded with respect to the upper end of the lower casing 21*a*. The cartridge casing 21 has its interior divided by three partition walls extending upward from the bottom of the lower casing 21*a* into four ink reservoirs 23 for holding yellow, magenta, cyan, and black colors of ink. The four colors of ink are stored in the respective ink reservoirs 23 in a state absorbed in ink absorbent materials.

The lower casing 21*a* has the bottom thereof formed with four ink delivery ports 24 in communication with the respective four ink reservoirs 23. Arranged in the vicinity of the four ink delivery ports 24 are two rows of protection ribs 25, 25 protruding downward from the bottom of the lower casing 21*a*. The delivery port-sealing film 5 is removably affixed by hot-melt bonding to a portion of the bottom of the lower casing 21*a* between the two rows of the protection ribs 25, 25 where the ink delivery ports 24 open, for collectively sealing the ink delivery ports 24. The delivery port-sealing film 5 is comprised of a sealing portion 31 for sealing the ink delivery ports 24 and an unsealing operation portion 32 continuous with the sealing portion 31. Portions of the sealing portion 31 facing the respective ink delivery ports 24 are depressed therein by hot-melt bonding of the sealing portion 21 to seal them. Further, when the ink cartridge 2 is contained in the container box 3, one end (extended proximal end) 33 of the sealing portion 31 extends upward along an inner surface of the container box 3 and fixed thereto. It should be noted that the one end 33 of the sealing portion 31 may extend out from a slit 63, described hereinafter, for instance, to be affixed to an outer surface of the container box 3. Such a construction is preferred particularly when one of the front and back of the delivery port-sealing film 5 has a so-called adhesive-receiving surface.

In a state where the ink cartridge 2 is contained in the container box 3, the unsealing operation portion 32 is bent into a U shape at an root end thereof merging into the sealing portion 31, and extends along a bottom surface of the container box 3 to extend out of the container box 3 through the slit 63, described hereinbelow. Then, the externally extended portion of the unsealing operation portion 32 further extends along a side surface of the container box 3 up to a top surface of the ink cartridge 2. In this embodiment, the externally extended portion of the unsealing operation portion 32 is covered with a belt-like portion 59, described hereinafter, of the container box 3 such that the externally extended portion is in contact with the side surface of the container box 3, and has the distal end portion 34 thereof inserted under the lid 3*b* along with an end (insertion portion 59b) of the belt-like portion 59. The distal end portion 34 of the unsealing operation portion 32 is fixedly attached to an inner surface of the insertion portion 59*b* of the belt-like portion 59.

The delivery port-sealing film 5 constructed as above is peeled off, starting from the end of the sealing portion 31 in the following manner: After the lid 3*b* of the container box 3 is opened, the belt-like portion 59 is unfolded and the insertion portion 59*b* of the belt-like portion 59 is pulled out to thereby pull the distal end portion 34 of the unsealing operation portion 32. This causes the sealing portion 31 to be drawn out in a manner making a U-turn whereby the delivery port-sealing film 5 is peeled off. When the sealing portion 31 is completely peeled of f the ink cartridge 2, the container box 3 is then pulled by the one end 33 of the sealing portion 31, whereby the pulling operation is hindered. Thus, the user can make sure that peeling of the delivery port-sealing film 5 has been completed.

The upper casing 21*b* has four circular ink-charging ports 26 and four air inlet ports 27 formed therethrough in a manner corresponding to the respective ink delivery ports 24 of the lower casing 21*a*. Further, the upper casing 21*b* has a top surface formed with four air inlet grooves 28 whose downstream ends lead to the four air inlet ports 27, respectively. Each air inlet groove 28 is formed in a manner meandering over the top surface of the upper casing 21*b* so as to provide a long path through which air is permitted to flow into the ink cartridge 2. The four air inlet grooves 28 have respective upstream ends extending to a central portion of the top surface of the upper casing 21*b* in parallel with each other. It should be noted that reference numeral 22*a* appearing in FIGS. 2A and 2B indicates positioning projections for preventing the ink cartridge 2 from being mounted in the printer in a horizontally reversed direction.

The air inlet port-sealing film 4 is removably affixed to the top surface of the upper casing 21*b* by hot-melt bonding in a manner covering (sealing) the openings of the ink-charging ports 26, the air inlet ports 27, and the air inlet grooves 28, that is, the whole area of the top surface of the upper casing 21*b*, from above. The air inlet port-sealing film 4 and the four air inlet grooves 28 define four air inlet passages 29 leading to the ink reservoirs 23 via the air inlet ports 27, respectively. That is, the four air inlet passages 29 have upstream ends 29*a* arranged in parallel with each other in the central portion of the top surface of the upper casing 21*b*, meandering portions extending from the upstream ends 29*a*, and downstream ends continuing from the meandering portions and communicating with the air inlet ports 27, respectively. By opening the upstream ends 29*a* of the meandering air inlet passages 29 to the atmosphere, the air inlet ports 27 are communicated with the atmosphere.

The air inlet port-sealing film 4 has a portion covering the upstream ends 29*a* of the air inlet passages 29, which is extended at right angles to the air inlet port-sealing film 4 to form a long belt portion. The long belt portion is a peeling operation portion (air inlet port-unsealing operation portion) 41 for use in peeling off part (peel-off portion) of the air inlet port -sealing film 4, and the portion covering the upstream ends 29*a* is the peel-off portion (air inlet port -sealing portion) 42 defined by perforated lines for being actually peeled off. In short, the air inlet port-sealing film as defined in claim 6 appended hereto is constituted by the peeling operation portion 41 and the peel-off portion 42.

In a state in which the ink cartridge 2 contained in the container box 3, the peeling operation portion 41 is bent or folded to form a U shape together with the peel-off portion 42, and the distal end portion thereof is fixedly attached to an inner surface of an opening tab 52, described hereinafter, of the lid 3*b*. When the opening tab 52 is pulled up so as to open the lid 3*b*, the peeling operation portion 41 is drawn, whereby the peel-off portion 42 is torn along the perforated lines off the ink cartridge 2. It should be noted that the air inlet port-sealing film 4 may be formed of a uniaxially oriented film. In such a case, there is no need to provide perforated lines restricting the width of the peel-off portion 42.

Figure 3:
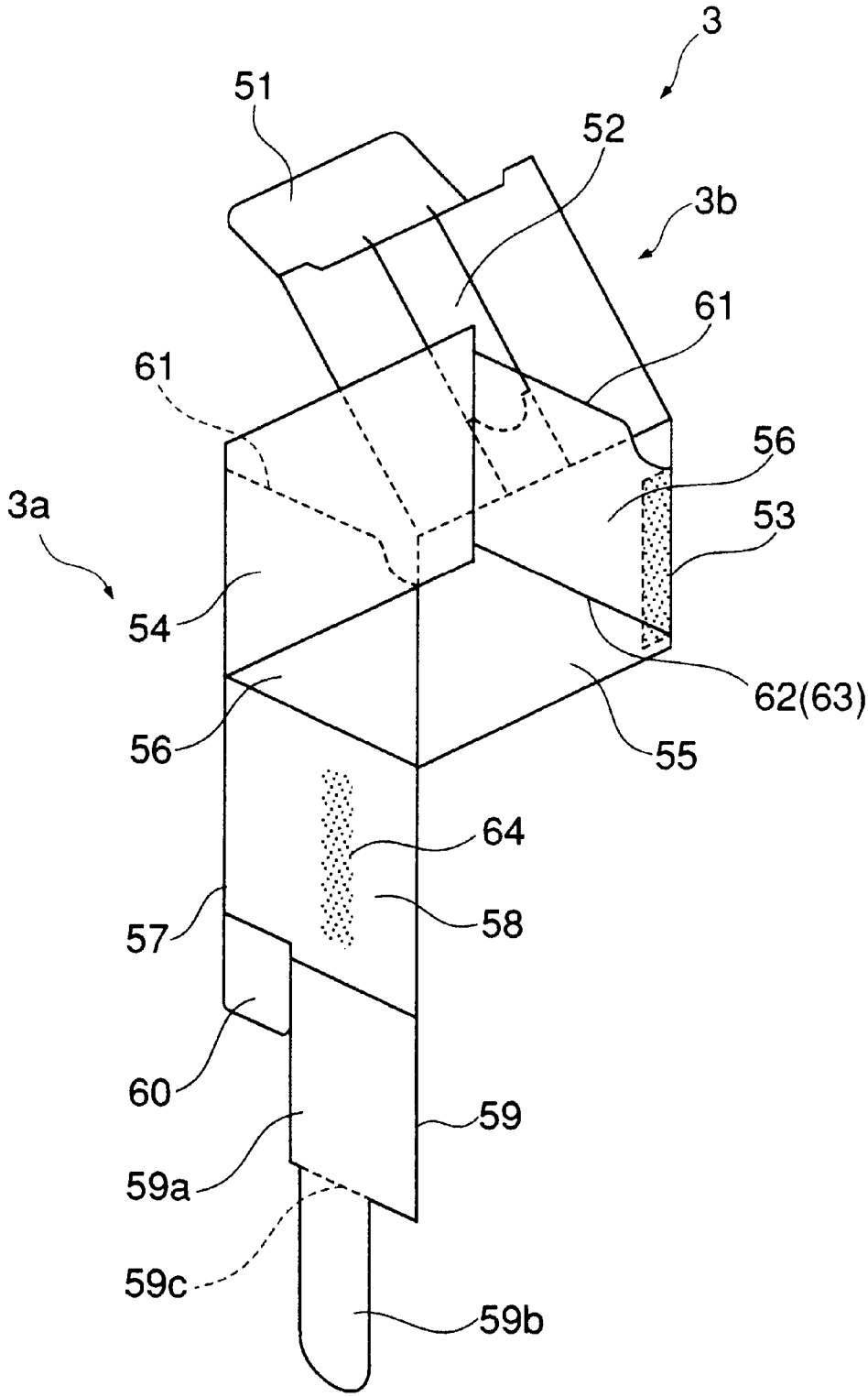
FIG. 3 is a perspective view of an appearance of a container box in a partially unfolded state.

As shown in FIGS. 1A, 1B, and in FIG. 3 in which the container box 3 is shown in a partially-unfolded state, the container box is constructed by cutting out a flat or pre-folded corrugated cardboard, and folding the cut-out cardboard into the shape of a box. The container box 3 is comprised of the box body 3*a*, and the lid 3*b* integrally formed with the box body 3*a*, for bendably closing the top opening of the box body 3*a*. The lid 3*b* has a free end formed with an upper bend 51 for insertion into the box body 3*a* to close the lid 6, such that the upper bend 51 overlaps a wall of the box body 3*a*. Further, the upper bend 51 has side end portions cut away so as to avoid the positioning projections 22*a* of the upper casing 21*b*. At a central portion of the lid 3*b* is formed a U-shaped cut line cut from a root portion of the upper bend 51. A portion surrounded by the cut line forms the opening tab 52. The distal end portion of the peeling operation portion 41 of the air inlet port-sealing film 4 is fixedly attached to the inner surface of the opening tab 52.

The box body 3*a* includes a hollow body 53 comprised of a front board portion 54, a rear board portion 55 and opposite side board portions 56, and a bottom 57 comprised of a bottom board portion 58, the belt-like portion 59 and a lower bend 60. From an upper end of the rear board portion 55 bendably extends the lid 3*b*, and from a lower end of one of the side board portions 56 bendably extends the bottom 57. Upper end portions of the respective side board portions 56 are cut away to form upper cut-away portions 61 for permitting the peripheral portion 22 of the upper casing 21*b* to be extend thereat. Further, the other of the side board portions 56 has a lower end portion cut away and this lower cut-away portion 62 and the bottom board portion 58 folded form therebetween the slit 63 for permitting the above unsealing operation portion (delivery port-sealing film 5) 32 to extend out of the box body 3*a*.

The belt-like portion 59 and the lower bend 60 bendably extend from an end of the bottom board portion 58. The belt-like portion 59 is comprised of a belt-like portion body 59*a* which is brought into contact with the other of the side board portions 56 when the belt-like portion 59 is folded as part of the container box 3, and the insertion portion 59*b* which is folded for insertion under the lid 3*b* when the belt-like portion 59 is folded. At a boundary between the belt-like portion body 59*a* and the insertion portion 59*b* there is formed a perforated line 59*c* such that the insertion portion 59*b* can be torn away from the belt-like portion body 59*a*. The unsealing operation portion 32 extending out of the box body 3*a* through the slit 63 is sandwiched between the inner surface of the belt-like portion 59 folded and the side board portion 56, and the distal end portion 34 of the unsealing operation portion 32 is fixedly attached to the inner surface of the insertion portion 59*b*.

When the delivery port-sealing film 5 is being peeled off, the sealing portion 31, that is, a portion stained with ink is brought into sliding contact with an inner surface of the bottom board portion 58. Therefore, it is preferable to shag the contacting portion of the inner surface of the bottom board portion 58 to form an ink-absorbing portion 64 for absorbing the ink thereby (see FIGS. 1A and 1B). Of course, ink absorbent material paper may be attached to the contacting portion to form the ink-absorbing portion 64. Further, as described hereinafter, the sealing portion 31 drawn out of the container box 3 is also brought into sliding contact with the belt-like portion body 59*a*. Therefore, it is more preferable to provide an ink-absorbing portion 64 on the belt-like portion body 59*a*.

The container box 3 having the above construction is fabricated according to the following procedure: The front board portion 54, the rear board portion 55, and the opposite side board portions 56 are folded from a pre-folded state thereof, and then, a side end portion of one of the side board portions 56 is bonded to the rear board portion 55 to thereby form the hollow body 53. Then, the bottom board portion 58 is folded to insert the lower bend 60 into the hollow body 53, whereby the bottom 57 is formed. Further, after the belt-like portion body 59*a* is folded to extend along the one of the side board portions 56, the insertion portion 59*b* is folded such that the insertion portion 59*b* faces the top opening of the box body 3*a*. Finally, the lid 3*b* is folded such that the upper bend 51 is inserted into the hollow body 53.

Figure 4A:
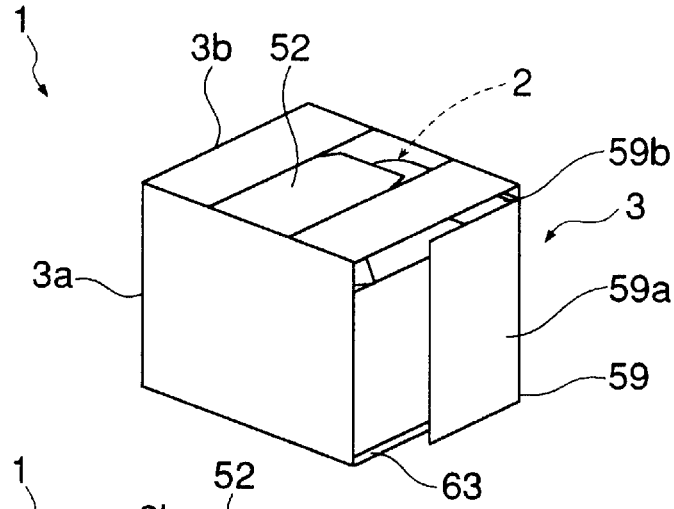
FIGS. 4A to 4F are perspective views of appearances of the ink cartridge device, which are useful in explaining a procedure of taking out the ink cartridge from the container box.
Figure 4B:
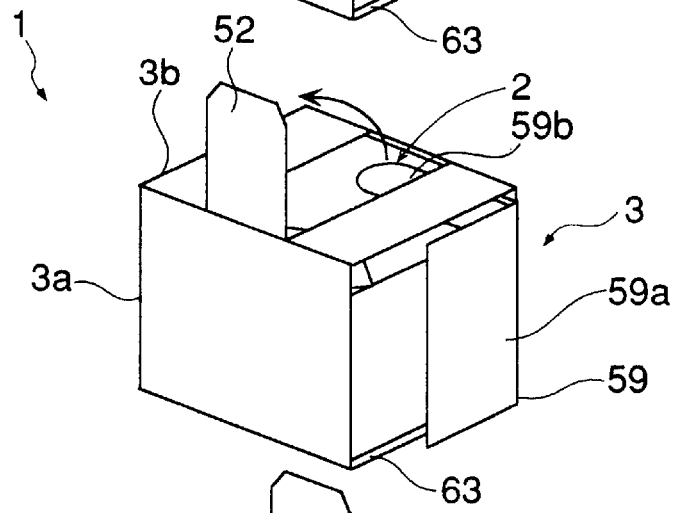
Figure 4C:
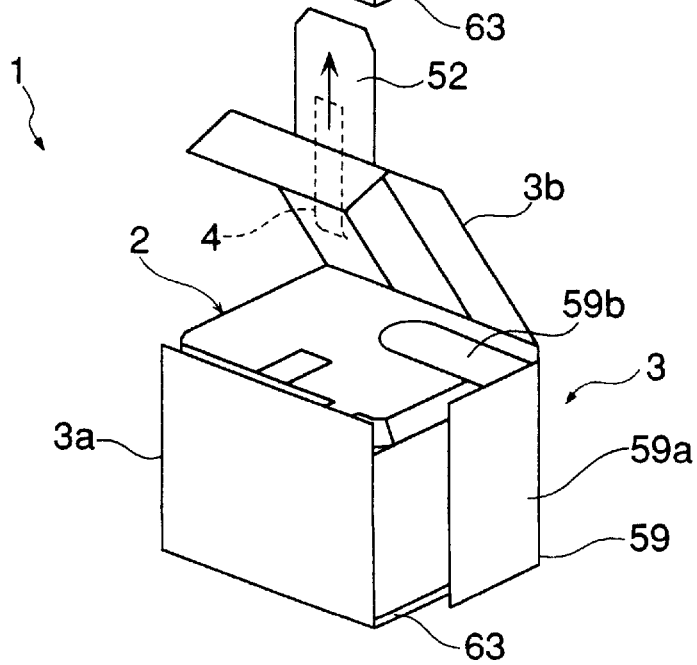
Figure 4D:
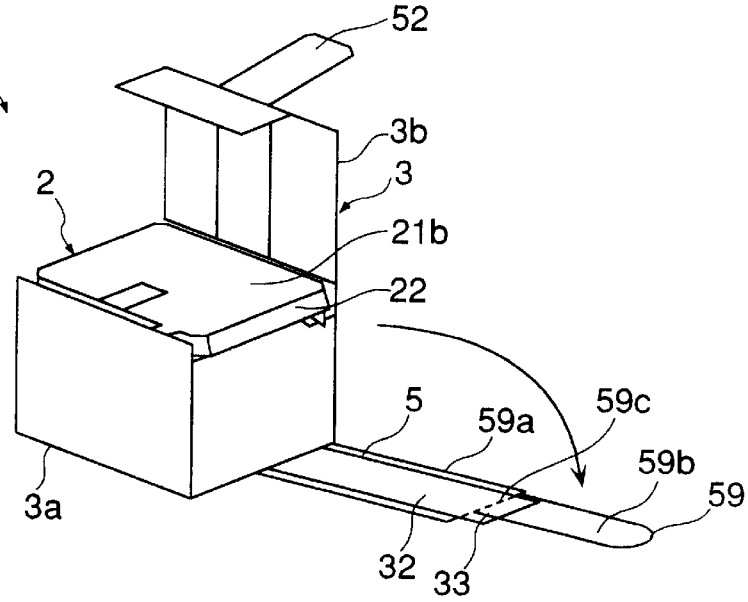

Now, a procedure of taking out the ink cartridge 2 from the container box 3 will be described with reference to FIGS. 4A to 4F. As shown in FIG. 4A, a new ink cartridge 2 is contained in the container box 3 constructed by folding the cut-out corrugated cardboard into the shape of a rectangular parallelepiped, as described above. From this state, first, the opening tab 52 is raised (FIG. 4B) and then, the opening tab 52 is pulled up to open the lid 3*b*. When the lid 3*b* is opened, the peel-off portion 42 of the air inlet port-sealing film 4 is peeled off the ink cartridge 2 in accordance with the opening operation (FIG. 4C).

Figure 4E:
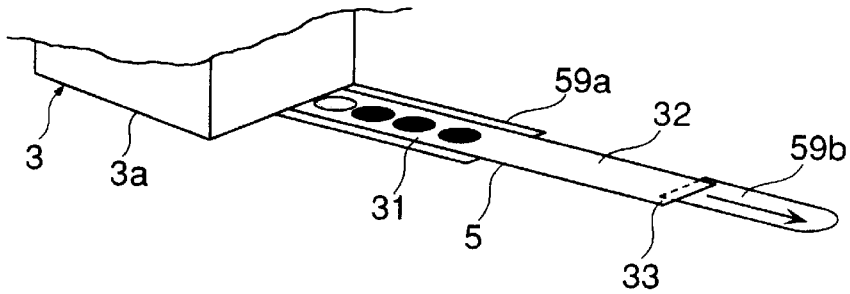

Next, the belt-like portion 59 is unfolded (FIG. 4D), and while holding the container box, the insertion portion 59*b* is cut off from the belt-like portion body 59*a* and pulled in a horizontal direction. This causes the delivery port-sealing film 5 in the container box 3 to be peeled off the ink cartridge 2 and drawn out from the box (FIG. 4E). In this process, if all of (four) portions of the delivery port-sealing film 5 stained with ink appear on the belt-like portion body 59*a* and the delivery port-sealing film 5 cannot be drawn out any further, it is confirmed that the peeling of the delivery port-sealing film 5 has been completed, so that the operation for drawing out the film is stopped.

Figure 4F:
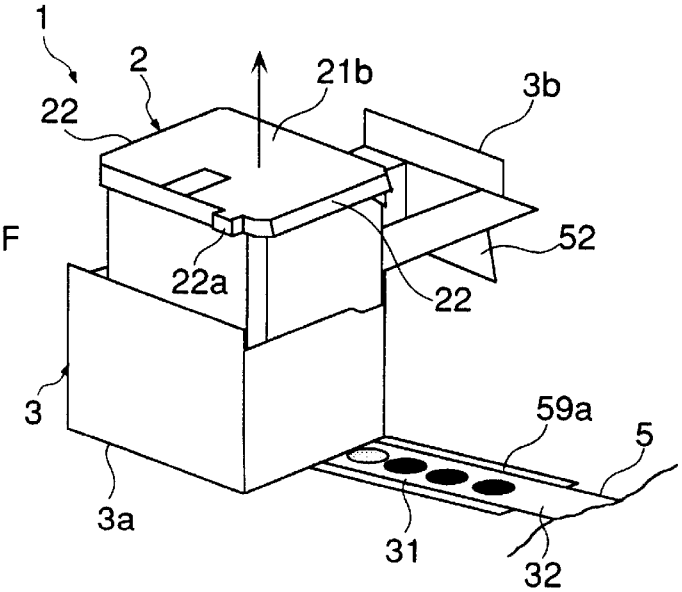

Then, portions of the peripheral portions 22 of the upper casing 21*b* positioned on the upper cut-away portions 61 of the opposite side board portions 56 are seized to pull out the ink cartridge 2 (FIG. 4F). The ink cartridge 2 pulled out is mounted as it is in the printer, while the container box 3 is disposed of along with part of the air inlet port-sealing film 4 and the delivery port-sealing film 5.

As described above, according to the above-mentioned embodiment, the belt-like portion 59 cannot be unfolded without opening the lid 3*b*, which inevitably ensures that the films are peeled off (unsealing operations therefor are carried out) in order of (the peel-off portion 42 of) the air inlet port-sealing film 4 and the delivery port-sealing film 5. This prevents air from being directly blown into the ink held within the ink cartridge 2 under reduced pressure from the ink delivery ports 24, thereby suitably preventing air from being mixed into the ink.

Further, the delivery port -sealing film 5 can be peeled off (the ink delivery ports 24 can be unsealed) without removing the ink cartridge from the container box 3, so that even if ink is scattered or spilled from the ink delivery ports 24, the scattered or spilled ink can be received within the container box 3. Moreover, the delivery port-sealing film 5 is peeled off in a direction orthogonal to the direction of the axis of each ink delivery port 24. Hence, the peeling operation is carried out relatively slowly and at the same time shock caused by the peeling operation is prevented from being applied in the direction of leakage of ink, whereby it is possible to minimize the amount of spilled ink. Further, portions of the drawn-out delivery port-sealing film 5, stained with ink, can be received on the belt-like portion body 59*a*. Accordingly, it is possible to prevent the user's hands or a desk from being stained with ink when the delivery port-sealing film 5 is peeled off. Moreover, the air inlet port-sealing film 4 and the delivery port-sealing film 5 can be disposed of in a state fixedly attached to the container box 3.

Figure 5A:
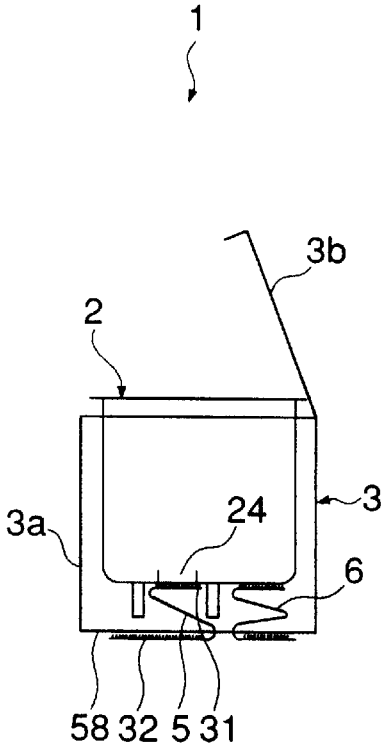
FIGS. 5A to 5C are cross-sectional views of an ink cartridge device according to a second embodiment of the invention, which are useful in explaining peeling of a delivery port-sealing film of the ink cartridge device effected when an ink cartridge of the inlet cartridge device is drawn out from a container box of the same and braking of the drawing operation.
Figure 5B:
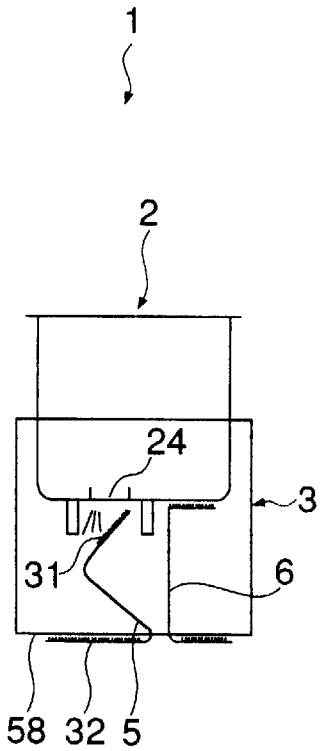
Figure 5C:
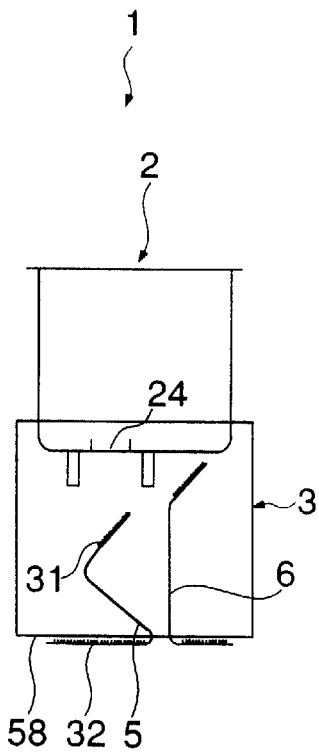

Next, a second embodiment of the invention will be described with reference to FIGS. 5A to 5C. Although in this embodiment, the air inlet port-sealing film 4, not shown in these figures, is provided in the same manner as in the first embodiment described above, the distal end portion 34 of the unsealing operation portion 32 of the delivery port-sealing film 5 extends through the bottom board portion 58 of the container box 3 and is fixedly attached to a lower or outer surface of the bottom board portion 58. Or alternatively, the distal end portion 34 of the unsealing operation portion 32 is fixedly attached to an upper or inner surface of the bottom board portion 58. Further, there is provided an auxiliary film 6 which has one end thereof removably affixed to the bottom of the ink cartridge 2 by hot-melt bonding and the other end thereof extending through the bottom board portion 58 of the container box 3 and fixedly attached to the lower or outer surface of the bottom board portion. The auxiliary film 6 is made of a film having the same properties as those of the delivery port-sealing film 5 and has a function of braking a drawing operation for drawing out the ink cartridge 2 from the container box 3.

More specifically, when the lid 3*b* of the container box 3 is opened, the air inlet port-sealing film 4 is peeled off in the same manner as in the first embodiment and next, when the ink cartridge 2 is drawn out from the container box 3, the delivery port-sealing film 5 is peeled off at a time point at which approximately half of the ink cartridge 2 is drawn out. Further, immediately before the ink cartridge 2 has been completely drawn out, the auxiliary film 6 is peeled off.

As described above, when the delivery port-sealing film 5 is peeled off, the ink cartridge 2 remains within the container box 3, so that even if ink is scattered or spilled from the ink delivery ports 24 when the delivery port-sealing film 5 is peeled off, the scattered or spilled ink can be received within the container box 3. Further, since the delivery port-sealing film 5 is left in the container box 3, the delivery port-sealing film 5 stained with ink can also be confined within the container box 3.

Further, immediately before the ink cartridge 2 has been completely drawn out, the auxiliary film 6 is peeled off, so that the operation for drawing out the ink cartridge 2 is braked, thereby preventing the ink cartridge 2 from being suddenly or violently drawn out of the container box 3. This makes it possible to prevent ink which has leaked through the ink delivery ports 24 from being scattered out of the container box 3 due to the momentum of the ink cartridge 2 drawn out.

Figure 6:
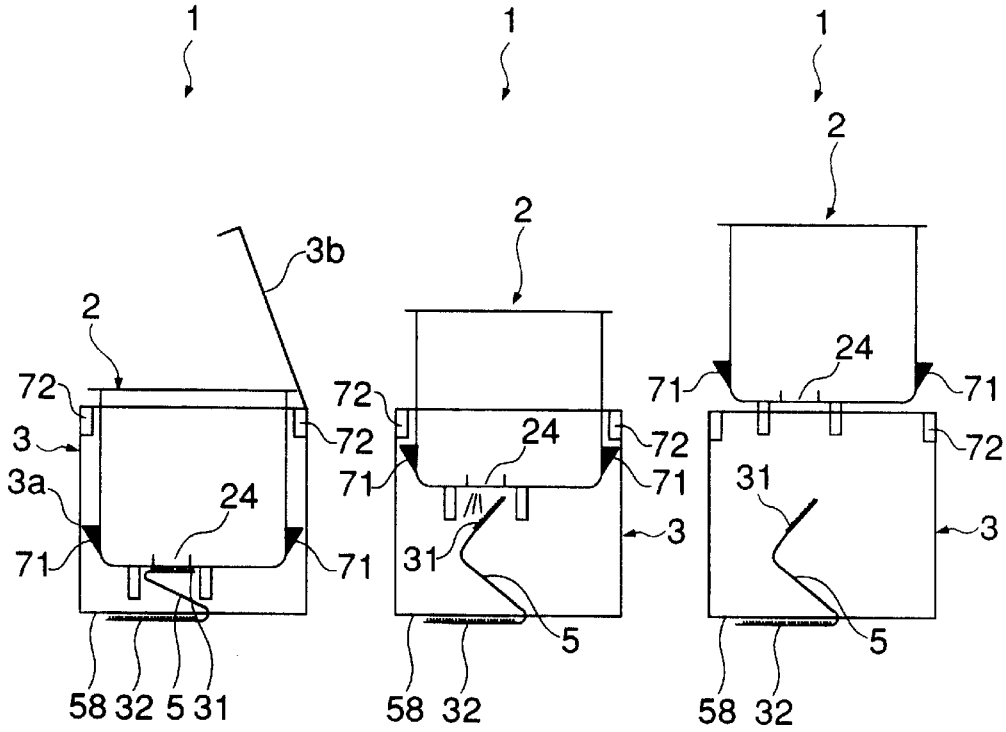

Next, a third embodiment of the invention will be described with reference to FIGS. 6A to 6C. In this embodiment, the air inlet port-sealing film 4 and the delivery port-sealing film 5 are arranged in the same manner as in the second embodiment. However, the ink cartridge 2 has outward projections 71 arranged on outer surfaces of a lower portion thereof, while the container box (box body 3*a*) 3 has inward projections 72 on inner surfaces of an upper portion thereof. The outward projections 71 and the corresponding inward projections 72 cooperate with each other to brake the drawing operation for drawing out the ink cartridge 2 from the container box 3.

More specifically, after opening the lid 3*b* to thereby peel off the air inlet port-sealing film 4, when the ink cartridge 2 is drawn out from the container box 3, the delivery port-sealing film 5 is peeled off at a time point at which approximately half of the ink cartridge 2 is drawn out. Further, immediately before the ink cartridge 2 has been completely drawn out, the outward projections 71 and the corresponding inward projections 72 are brought into sliding contact with each other to brake the drawing operation for drawing out the ink cartridge 2 from the container box 3.

In this embodiment as well, similarly to the second embodiment, even if ink is scattered or spilled from the ink delivery ports 24 when the delivery port-sealing film 5 is peeled off, the scattered or spilled ink can be received within the container box 3, and at the same time the delivery port-sealing film 5 stained with ink can also be confined within the container box 3. Further, it is possible to prevent ink which has leaked through the ink delivery ports 24 from scattering out of the container box 3.

Figures 7A, 7B, 7C:
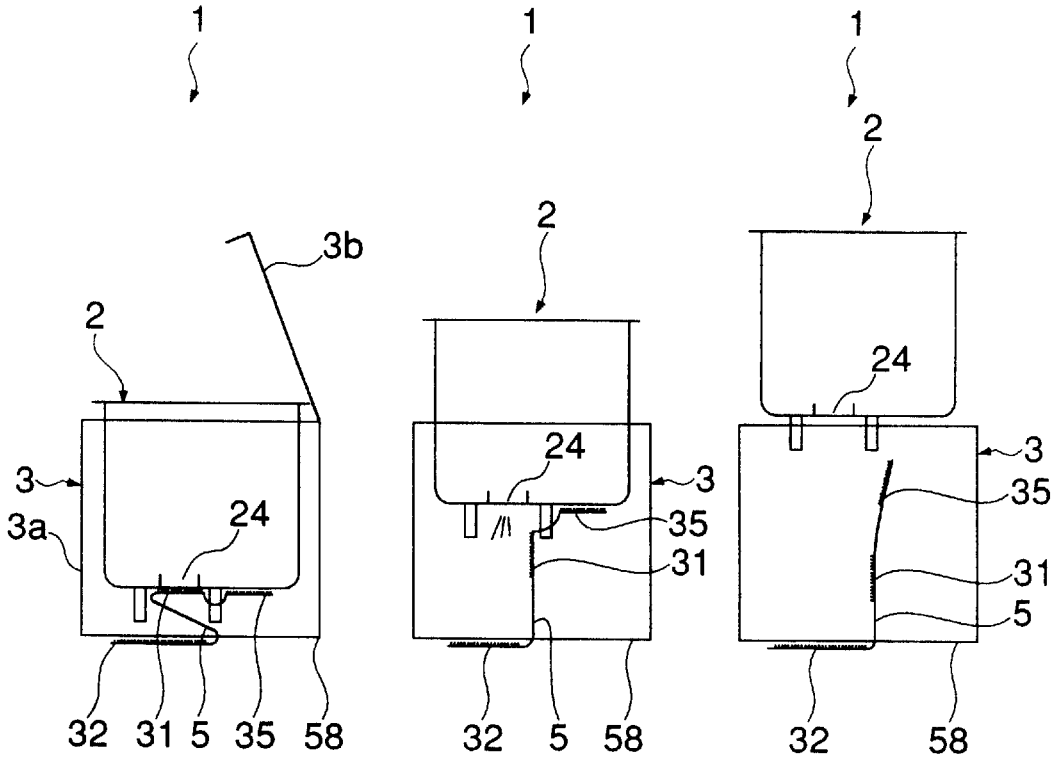
FIGS. 7A to 7C are cross-sectional views of an ink cartridge device according to a fourth embodiment of the invention, which are useful in explaining peeling of a delivery port-sealing film of the ink cartridge device effected when an ink cartridge of the inlet cartridge device is drawn out from a container box of the same and braking of the drawing operation.

Next, a fourth embodiment of the invention will be described with reference to FIGS. 7A to 7C. In this embodiment, the air inlet port-sealing film 4 and the delivery port-sealing film 5 are arranged in the same manner as in the second embodiment. The sealing portion 31 of the delivery port-sealing film 5, however, has an outer end extended further forward. This extended portion (affixed portion) 35 is removably affixed to a bottom surface of the ink cartridge 2 by hot-melt bonding, for braking the operation for drawing out the ink cartridge 2 from the container box 3.

More specifically, as the lid 3*b* of the container box 3 is opened, the air inlet port-sealing film 4 is peeled off in the same manner as described above as to the first embodiment. Then, when the ink cartridge 2 is drawn out from the container box 3, the sealing portion 31 of the delivery port-sealing film 5 is peeled off at a time point at which approximately half of the ink cartridge 2 is drawn out. Further, immediately before the ink cartridge 2 has been completely drawn out, the extended portion 35 is peeled off.

Figure 8:
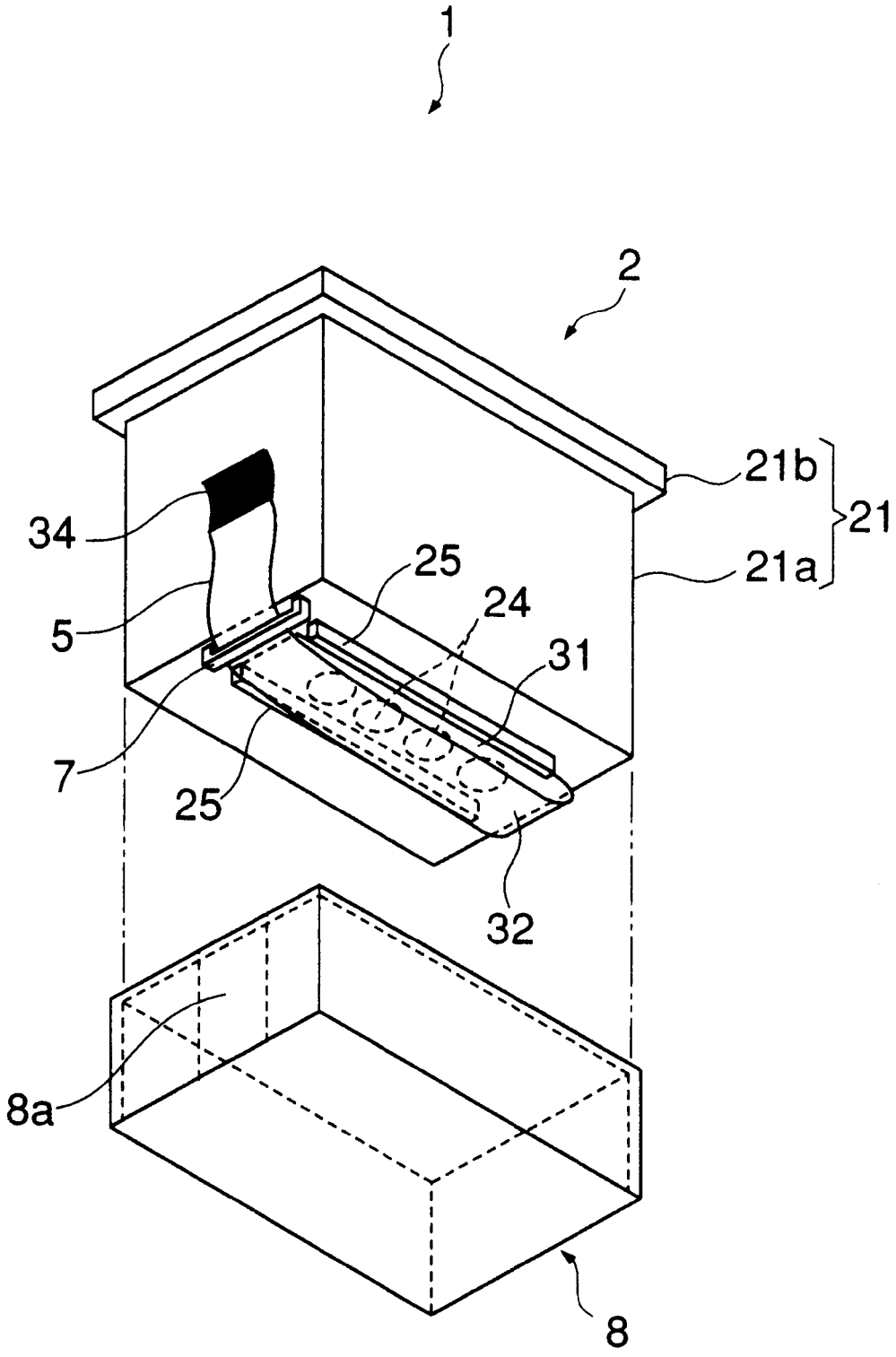
FIG. 8 is a partially exploded perspective view of an ink cartridge device according to a fifth embodiment.
Figure 9A:
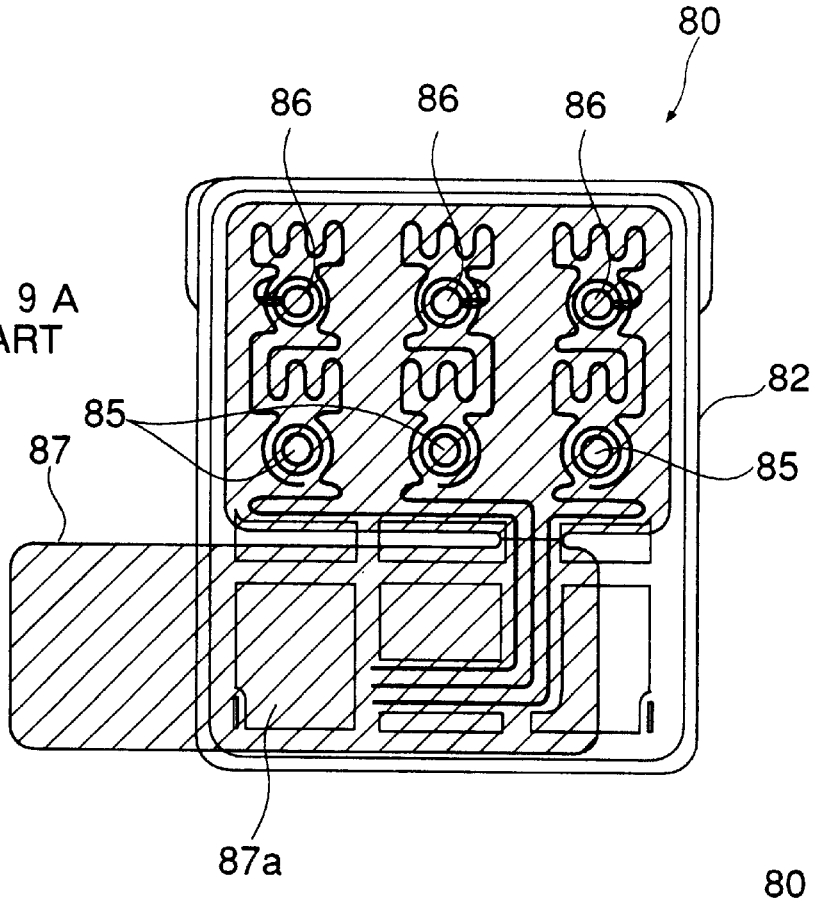
F I G. 9 A PRIOR ART
FIG. 9A is a plan view of a conventional ink cartridge.
Figure 9B:
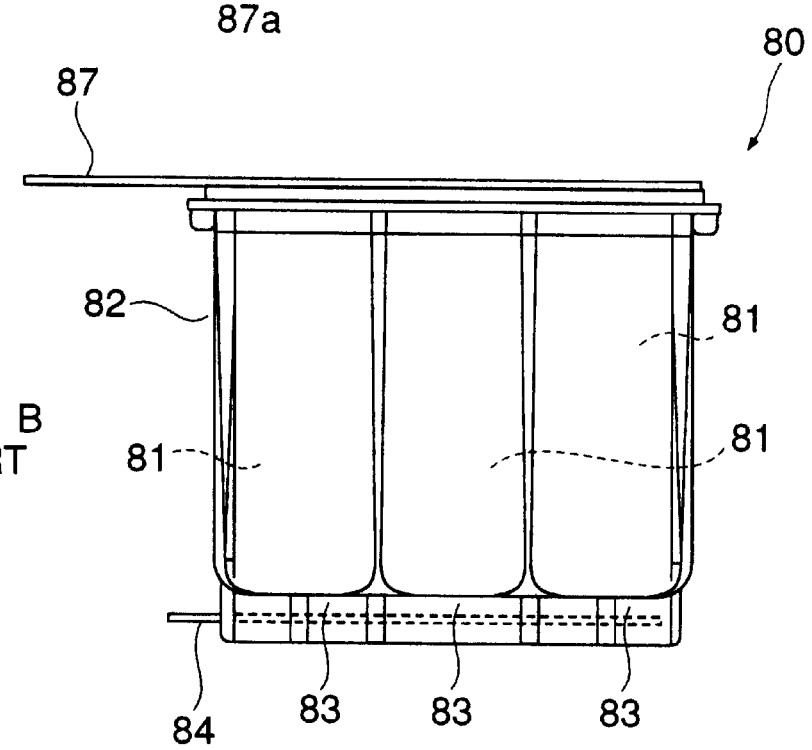
F I G. 9 B PRIOR ART
FIG. 9B is a front elevational view of the conventional ink cartridge.

Therefore, in this embodiment as well, similarly to the second embodiment, even if ink is scattered or spilled from the ink delivery ports 24 when the delivery port-sealing film 5 is peeled off, the scattered or spilled ink can be received within the container box 3, and at the same time the delivery port-sealing film 5 stained with ink can also be confined within the container box 3. Further, it is possible to prevent ink which has leaked through the ink delivery ports 24 from scattering out of the container box Next, a fifth embodiment of the invention will be described with reference to FIG. 8. In this embodiment, the ink cartridge 2 has a bottom surface integrally formed with a peeling guide portion 7 for restricting the direction of an operation for peeling off the delivery port-sealing film 5 to a direction of the sealing portion 31 making a U-turn. The peeling guide portion 7 is U-shaped and placed close to ends of the opposed protection ribs 25 at right angles to the same. The unsealing operation portion 32 of the delivery port-sealing film 5, which continues from the sealing portion 31 of the same sealing the ink delivery ports 24, makes a U-turn with respect to the sealing portion 31, and passes through the peeling guide portion 7 to further extend to a side surface of the ink cartridge 2.

Further, to a lower portion of the ink cartridge 2 is removably mounted a scattering prevention tray (scattering prevention member) 8 made of corrugated cardboard in place of the container box 3. In this embodiment, when the ink cartridge 2 is mounted to the printer, the distal end portion 34 of the unsealing operation portion 32 serving as a pull tab extends out of the scattering prevention tray 8. When the distal end portion 34 is pulled, a precut holding portion 8*a* of the scattering prevention tray 8 is broken to fall down, and further, the sealing portion 31 is peeled off the ink cartridge 2. Of course, prior to this peeling operation, (part of) the air inlet port-sealing film 4 is peeled off in advance. Further, after the delivery port-sealing film5 is peeled off, the scattering prevention tray 8 is removed from the ink cartridge 2 and disposed of.

According to this arrangement of the ink cartridge device, even if ink is scattered or spilled from the ink delivery ports 24 when the delivery port-sealing film 5 is peeled off, the scattered or spilled ink can be received within the scattering prevention tray 8, and at the same time the delivery port-sealing film 5 stained with ink can also be received within the scattering prevention tray 8. Further, as described above, if the delivery port-sealing film (sealing portion 31) 5 is peeled off in a direction of the sealing portion 31 making a U-turn, scattering of ink is relatively effectively suppressed. Therefore, a variation of the present embodiment may be constructed such that the scattering prevention tray 8 is omitted, and peeling of the delivery port-sealing film 5 is carried out in the state of the ink cartridge 2 being placed upside down.

As described above, according to the ink cartridge device of the invention, the sealing portion is peeled off in a direction of making a U-turn. Hence, it is possible to suppress scattering of ink from the ink delivery ports, and even if ink is scattered, the scattered ink can be received within the container box. This makes it possible to positively peel off the delivery port-sealing film as well as prevent ink from scattering when the delivery port -sealing film is peeled off, whereby the user's hands or a desk can be prevented from being stained with ink when the delivery port-sealing film is peeled off.

It is further understood by those skilled in the art that the foregoing are preferred embodiments of the invention, and that various changes and modifications may be made without departing from the spirit and scope thereof.

What is claimed is:

1. An ink cartridge device for a printer, comprising:

an ink cartridge having an ink delivery port for supplying ink to said printer therefrom, and a rim of said ink delivery port;

a container box for containing said ink cartridge, said container box having a box body and a lid for closing said box body, said box body being formed with a slit;

a delivery port-sealing film having a sealing portion removably welded to said rim of said ink delivery port, for sealing said ink delivery port, and an unsealing operation portion continuous with said sealing portion and extending in a direction of making a U-turn with respect to said sealing portion to extend out of said container box through said slit of said box body;

an end of said sealing portion remote from said unsealing operation portion being fixedly attached to said box body, and a distal end portion of said unsealing operation portion extending out of said container box being folded to extend under said lid in a closed state.

2. An ink cartridge device according to claim 1, wherein said box body has a belt-like portion extending therefrom such that said belt-like portion covers from outside said unsealing operation portion extending out of said container box, wherein said belt-like portion includes a holding portion holding said unsealing operation portion such that said unsealing operation portion extends along a side surface of said box body, and an insertion portion folded to be inserted under said lid together with said distal end portion of said unsealing operation portion; and wherein said insertion portion is separably continuous with said holding portion, and has said distal end portion of said unsealing operation portion being fixedly attached thereto.

3. An ink cartridge device according to claim 1, wherein an inner surface of said box body facing toward said ink delivery port is provided with an ink-absorbing portion capable of absorbing ink.

4. An ink cartridge device according to claim 1, wherein said box body has an upper end opposed to said lid, said upper end being formed with a cut-away portion for permitting said ink cartridge contained therein to be seized to null out said ink cartridge from said container box.

5. An ink cartridge device for a printer, comprising:

an ink cartridge having an ink delivery port for supplying ink to said printer therefrom, and a rim of said ink delivery port;

a delivery port-sealing film having a sealing portion removably welded to said rim of said ink delivery port, for sealing said ink delivery port, and an unsealing operation portion continuous with said sealing portion, for being pulled to carry out a peeling operation for peeling off said sealing portion before said ink cartridge is mounted in said printer; and a peeling guide portion which restricts a direction of said peeling operation carried out by said unsealing operation portion to a direction of said sealing portion making a U turn, the peeling guide being integrally formed with a bottom surface of said ink cartridge, and being U-shaped and being disposed adjacent opposed protection ribs at right angles thereto.

6. An ink cartridge device according to claim 5, further including a scattering prevention member removably fitted on said ink cartridge such that said scattering prevention member covers said sealing portion, for receiving ink scattered during said peeling operation.

* * * * *